US010219590B1

(12) United States Patent
Eigenman

(10) Patent No.: US 10,219,590 B1
(45) Date of Patent: Mar. 5, 2019

(54) INTERCHANGEABLE DECORATIVE SNAPS

(71) Applicant: Shannon Eigenman, Hanford, CA (US)

(72) Inventor: Shannon Eigenman, Hanford, CA (US)

( * ) Notice: Subject to any disclaimer, the term of this patent is extended or adjusted under 35 U.S.C. 154(b) by 210 days.

(21) Appl. No.: 14/687,751

(22) Filed: Apr. 15, 2015

(51) Int. Cl.
*A41D 1/06* (2006.01)
*A44B 17/00* (2006.01)
*A41D 27/08* (2006.01)

(52) U.S. Cl.
CPC ..... *A44B 17/0058* (2013.01); *A41D 1/06* (2013.01); *A41D 27/08* (2013.01); *A44B 17/0041* (2013.01)

(58) Field of Classification Search
CPC ..... A41D 1/06; A41D 13/02; A41D 27/08; A41B 1/00; A41F 1/00
USPC ..... 2/227, 79, 115, 96, 243.1; 24/578.1
See application file for complete search history.

(56) References Cited

U.S. PATENT DOCUMENTS 2,179,032 A * 11/1939 Carley ..... A44B 1/44 24/578.12
2,648,110 A * 8/1953 Baskind ..... A44B 5/02 24/102 SL
2,799,910 A * 7/1957 Weber ..... A44B 17/0082 24/681
2,983,975 A 5/1961 Hubbell
3,141,211 A * 7/1964 Blake ..... A43B 23/24 24/114.4
3,979,802 A * 9/1976 Bongartz ..... A44B 17/0052 24/107
5,355,698 A * 10/1994 Edmark ..... A44C 17/0216 63/29.1
5,685,174 A 11/1997 Balzer et al.
7,725,958 B1 * 6/2010 Gilmore ..... A45F 5/02 2/310
7,832,022 B1 * 11/2010 Peters ..... A41D 1/08 2/227
8,561,264 B2 * 10/2013 Hasegawa ..... A44B 17/0023 24/108
9,408,439 B2 * 8/2016 Barce ..... A44B 1/04

* cited by examiner

*Primary Examiner* — Tejash Patel
(74) *Attorney, Agent, or Firm* — Stevenson IP, LLC

(57) ABSTRACT

Interchangeable decorative snaps including a plurality of snap fasteners, each of the plurality of snap fasteners having a bottom half and an interchangeable top half. The bottom half of each of the plurality of snap fasteners is configured to securely engage the top half of each of the plurality of snap fasteners. The bottom half of each of the plurality of snap fasteners can optionally be disposed on an article of clothing.

2 Claims, 4 Drawing Sheets

INTERCHANGEABLE DECORATIVE SNAPS

BACKGROUND OF THE INVENTION

Various types of decorative snaps are known in the prior art. However, what has been needed are interchangeable decorative snaps comprising a plurality of snap fasteners, wherein each of the plurality of snap fasteners has a bottom half and an interchangeable top half. What has further been needed is a plurality of decorative covers, wherein each of the plurality of decorative covers is attached to the top half of each of the plurality of snap fasteners. Lastly, what has been needed is for the bottom half of each of the plurality of snap fasteners to be disposed on an article of clothing. The article of clothing can optionally comprise pants, shorts, leggings, shirts, skirts, blazers, sweaters, jackets, head bands, belts, lingerie, hats, gloves, scarves, and shoes. Thus, a user can interchange the top half of each of the plurality of snap fasteners with each other in order to change the appearance of the article of clothing.

FIELD OF THE INVENTION

The present invention relates to decorative snaps, and more particularly, to interchangeable decorative snaps comprising a plurality of snap fasteners and a plurality of decorative covers.

SUMMARY OF THE INVENTION

The general purpose of the present interchangeable decorative snaps, described subsequently in greater detail, is to provide decorative snaps which have many novel features that result in interchangeable decorative snaps which are not anticipated, rendered obvious, suggested, or even implied by prior art, either alone or in combination thereof.

To accomplish this, the present interchangeable decorative snaps comprise a plurality of snap fasteners, wherein each of the plurality of snap fasteners has a bottom half and an interchangeable top half. The bottom half of each of the plurality of snap fasteners and the top half of each of the plurality of snap fasteners have a top surface and a bottom surface. The bottom half of each of the plurality of snap fasteners is configured to securely engage with the top half of each of the plurality of snap fasteners. The interchangeable decorative snaps further comprise a plurality of decorative covers, wherein each of the plurality of decorative covers is attached to the top surface of the top half of each of the plurality of snap fasteners. The plurality of decorative covers can optionally be tassels, diamonds, pearls, beads, leather, and lace. The bottom half of each of the plurality of snap fasteners can optionally be disposed on an article of clothing.

The interchangeable decorative snaps can optionally further comprise a pair of pants having an opening disposed on a pant leg. The opening has a top side, a bottom side, a right edge, and a left edge. A plurality of eyelets are continuously disposed on the pant leg proximal the right edge and the left edge. The plurality of snap fasteners further comprises a top snap fastener and a pair of bottom snap fasteners. The pair of bottom snap fasteners has a first snap fastener and a second snap fastener. The bottom half of the top snap fastener is disposed proximal the top of the opening, and the bottom half of the pair of bottom snap fasteners is disposed proximal the bottom of the opening. A pair of strings comprises a first string and a second string. Each of the first string and the second string has a top end and a bottom end.

The top end of the first string and the top end of the second string is attached to the top half of the top snap fastener. The bottom end of the first string is attached to the top half of the first snap fastener, and the bottom end of the second string is attached to the top half of the second snap fastener. The pair of strings is configured to be thread through the plurality of eyelets in order to close the opening on the pair of pants.

Thus has been broadly outlined the more important features of the present interchangeable decorative snaps so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
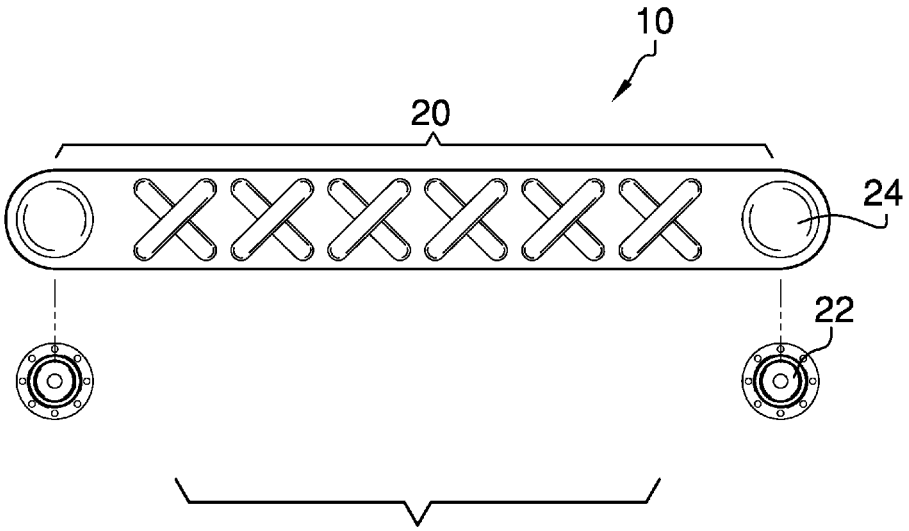
FIG. 1 is a top plan view.
Figure 2:
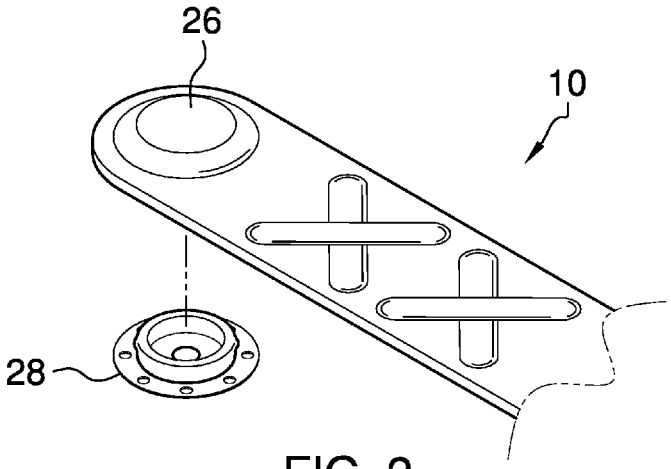
FIG. 2 is a front isometric view.

With reference now to the drawings, and in particular FIGS. 1 through 5 thereof, an example of the instant interchangeable decorative snaps employing the principles and concepts of the present interchangeable decorative snaps and generally designated by the reference number 10 will be described.

Referring to FIGS. 1 through 5, the present interchangeable decorative snaps 10 are illustrated. The interchangeable decorative snaps 10 comprise a plurality of snap fasteners 20, with each of the plurality of snap fasteners 20 having a bottom half 22 and an interchangeable top half 24. The bottom half 22 of each of the plurality of snap fasteners 20 and the top half 24 of each of the plurality of snap fasteners 20 have a top surface 26 and a bottom surface 28. The bottom half 22 of each of the plurality of snap fasteners 20 is configured to securely engage with the top half 24 of each of the plurality of snap fasteners 20. The interchangeable decorative snaps 10 further comprise a plurality of decorative covers 30, wherein each of the plurality of decorative covers 30 is attached to the top surface 26 of the top half 24 of each of the plurality of snap fasteners 20. The bottom half 22 of each of the plurality of snap fasteners 20 can optionally be disposed on an article of clothing.

Figure 3:
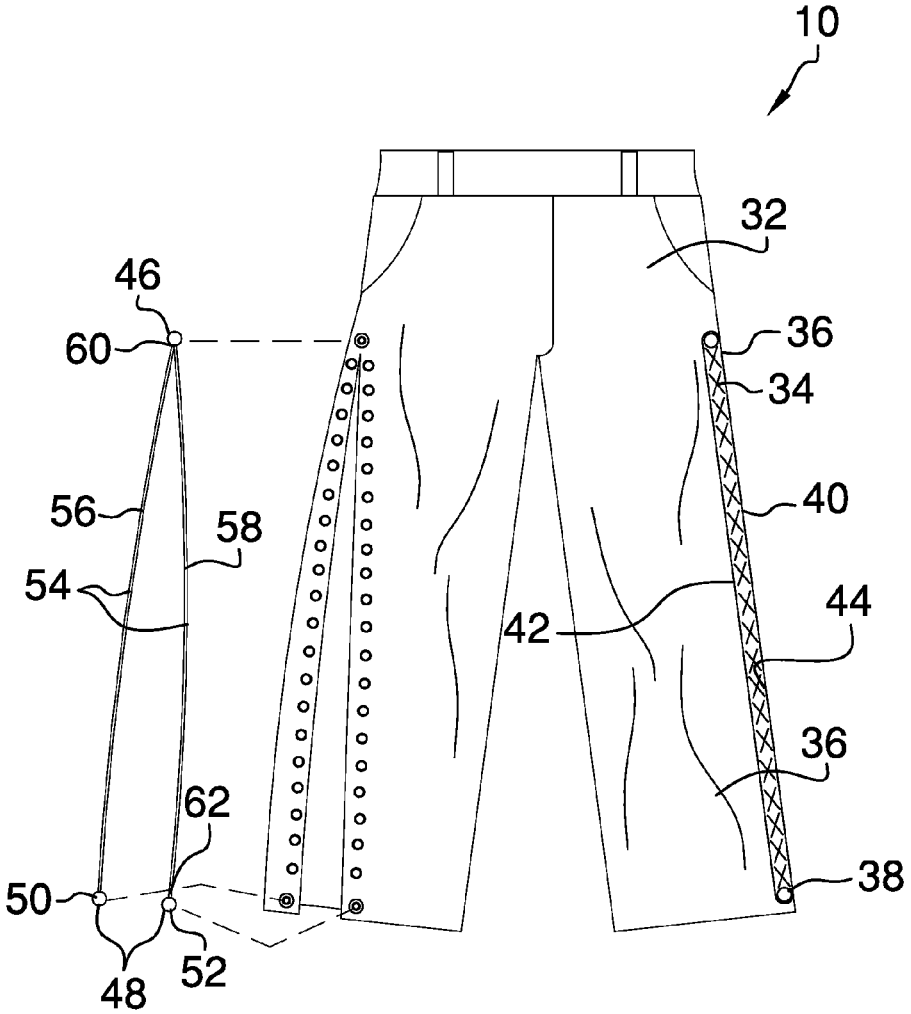
FIG. 3 is an in-use view showing a plurality of snap fasteners on a pair of pants.
Figure 4:
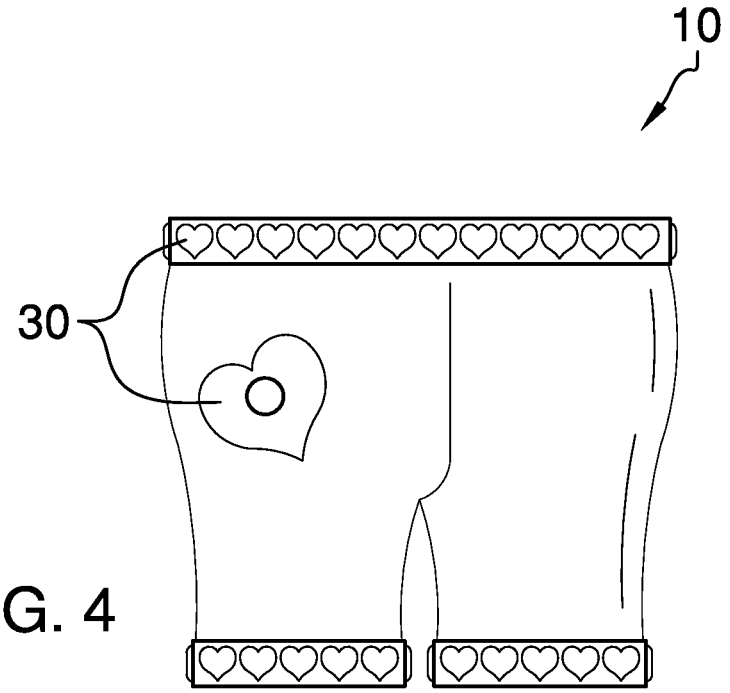
FIG. 4 is an in-use view showing a plurality of snap fasteners on a pair of shorts.
Figure 5:
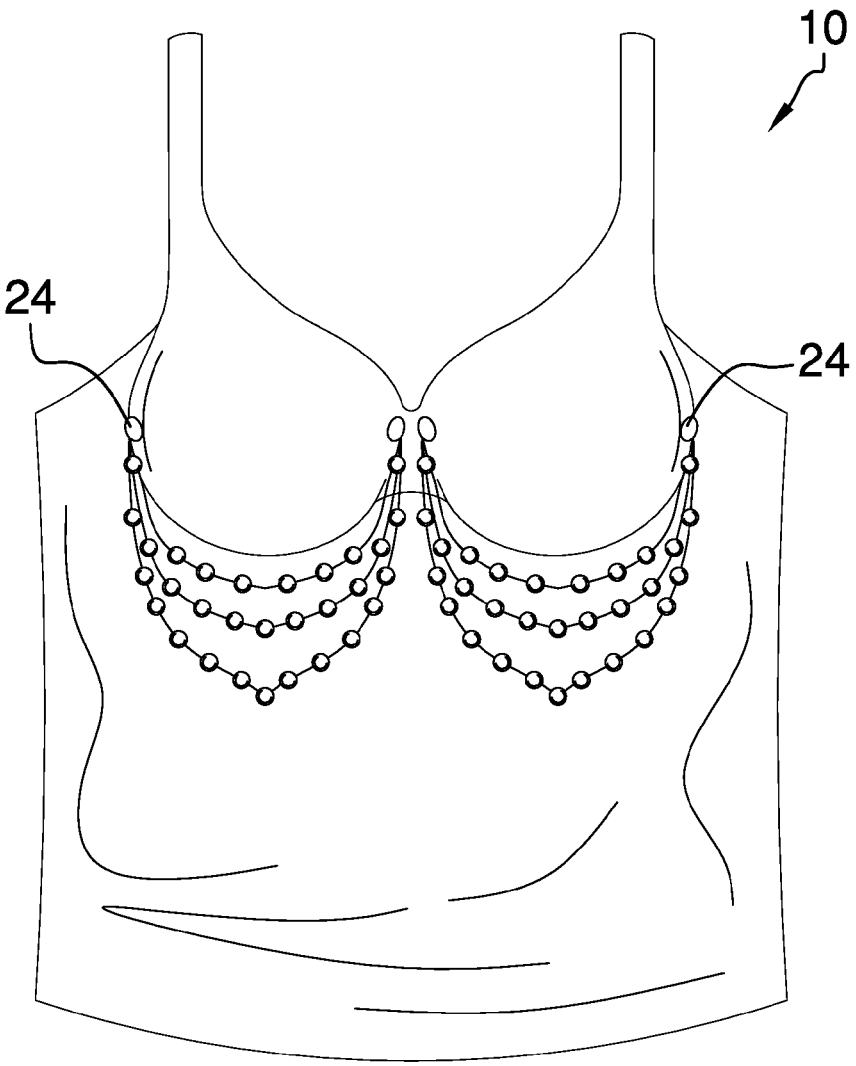
FIG. 5 is an in-use view showing a plurality of snap fasteners on a shirt.

As best shown in FIG. 3, the interchangeable decorative snaps can optionally further comprise a pair of pants 32 having an opening 34 disposed on a pant leg 36. The opening 34 has a top side 36, a bottom side 38, a right edge 40, and a left edge 42. A plurality of eyelets 44 are continuously disposed on the pant leg 36 proximal the right edge 40 and the left edge 42. The plurality of snap fasteners 20 further comprises a top snap fastener 46 and a pair of bottom snap fasteners 48. The pair of bottom snap fasteners has a first snap fastener 50 and a second snap fastener 52. The bottom half 22 of the top snap fastener 46 is disposed proximal the top side 36 of the opening 34, and the bottom half 22 of the pair of bottom snap fasteners 48 is disposed proximal the bottom side 38 of the opening 34. A pair of strings 54 comprises a first string 56 and a second string 58. Each of the first string 56 and the second string 58 has a top end 60 and a bottom end 62. The top end 60 of the first string 56 and the top end 60 of the second string 58 is attached to the top half 24 of the top snap fastener 46. The bottom end 62 of the first string 56 is attached to the top half 24 of the first snap fastener 50, and the bottom end 62 of the second string 58 is attached to the top half 24 of the second snap fastener 52. As best shown in FIG. 3, the pair of strings 54 is configured to be thread through the plurality of eyelets 44 in order to close the opening 34 on the pair of pants 32.

What is claimed is:

1. Interchangeable decorative snaps comprising:

a plurality of snap fasteners, each of the plurality of snap fasteners having a bottom half and an interchangeable top half, each of the bottom half and the top half having a top surface and a bottom surface;

wherein the bottom half of each of the plurality of snap fasteners is configured to securely engage with the top half of each of the plurality of snap fasteners; and a plurality of decorative covers, wherein each of the plurality of decorative covers is attached to the top surface of the top half of each of the plurality of snap fasteners;

wherein the bottom half of each of the plurality of snap fasteners is disposed on an article of clothing;

a pair of pants having an opening disposed on a pant leg, the opening having a top side, a bottom side, a right edge, and a left edge, wherein a plurality of eyelets are continuously disposed on the pant leg proximal the right edge and the left edge;

wherein the plurality of snap fasteners further comprises a top snap fastener and a pair of bottom snap fasteners, the pair of bottom snap fasteners having a first snap fastener and a second snap fastener;

wherein the bottom half of the top snap fastener is disposed proximal the opening top side and the bottom half of the pair of bottom snap fasteners is disposed proximal the opening bottom side;

a pair of strings comprising a first string and a second string, each of the first string and the second string having a top end and a bottom end;

wherein the first string top end and the second string top end is attached to the top half of the top snap fastener;

wherein the first string bottom end is attached to the top half of the first snap fastener and the second string bottom end is attached to the top half of the second snap fastener;

wherein the pair of strings is configured to be thread through the plurality of eyelets in order to close the opening on the pair of pants.

2. Interchangeable decorative snaps comprising:

a plurality of snap fasteners, each of the plurality of snap fasteners having a bottom half and an interchangeable top half, with each of the bottom half and the top half having a top surface and a bottom surface;

wherein the bottom half of each of the plurality of snap fasteners is configured to securely engage with the top half of each of the plurality of snap fasteners;

a plurality of decorative covers, wherein each of the plurality of decorative covers is attached to the top surface of the top half of each of the plurality of snap fasteners;

wherein the plurality of snap fasteners further comprises a top snap fastener and a pair of bottom snap fasteners, the pair of bottom snap fasteners further comprising a first snap fastener and a second snap fastener;

a pair of pants having an opening disposed on a pant leg, the opening having a top side, a bottom side, a right edge, and a left edge, wherein a plurality of eyelets are continuously disposed on the pant leg proximal the right edge and the left edge;

wherein the bottom half of the top snap fastener is disposed proximal the opening top side and the bottom half of the pair of bottom snap fasteners is disposed proximal the opening bottom side;

a pair of strings comprising a first string and a second string, each of the first string and the second string having a top end and a bottom end;

wherein the first string top end and the second string top end is attached to the top half of the top snap fastener;

wherein the first string bottom end is attached to the top half of the first snap fastener and the second string bottom end is attached to the top half of the second snap fastener;

wherein the pair of strings is configured to be thread through the plurality of eyelets in order to close the opening on the pair of pants.

* * * * *